US008621991B1

(12) United States Patent
Lopez et al.

(10) Patent No.: US 8,621,991 B1
(45) Date of Patent: Jan. 7, 2014

(54) PISTOL GRIP SPRING COMPRESSOR SYSTEM AND METHOD FOR MAINTAINING COMPRESSION ON A VALVE SPRING

(76) Inventors: Rodolfo Lopez, New Braufels, TX (US); Alexander Lopez, Bandera, TX (US)

( * ) Notice: Subject to any disclaimer, the term of this patent is extended or adjusted under 35 U.S.C. 154(b) by 266 days.

(21) Appl. No.: 13/211,278

(22) Filed: Aug. 16, 2011

Related U.S. Application Data

(60) Provisional application No. 61/376,221, filed on Aug. 23, 2010.

(51) Int. Cl.
*B25B 27/26* (2006.01)
*B30B 13/00* (2006.01)

(52) U.S. Cl.
USPC ..... 100/35; 100/219; 100/260; 100/266; 100/280; 29/213.1; 29/214; 29/215; 29/220

(58) Field of Classification Search
USPC ..... 100/35, 234, 214, 240, 260, 262, 265, 100/266, 280, 219; 29/231.1, 214, 215, 29/219, 220, 221, 213.1
See application file for complete search history.

(56) References Cited

U.S. PATENT DOCUMENTS

| | | | | |
|---|---|---|---|---|
| 1,426,799 | A * | 8/1922 | Weil | 29/219 |
| 3,727,291 | A * | 4/1973 | Babb | 29/251 |
| 3,949,459 | A | 4/1976 | Marenchin | |
| 3,955,831 | A | 5/1976 | Whitchurch | |
| 3,977,064 | A | 8/1976 | Mote | |
| 4,158,318 | A | 6/1979 | Strametz | |
| 4,262,403 | A | 4/1981 | Wilhelm et al. | |
| 4,331,345 | A | 5/1982 | Williams | |
| 4,376,331 | A | 3/1983 | Clark | |
| 4,438,944 | A | 3/1984 | Della-Moretta | |
| 4,446,608 | A | 5/1984 | Johnson | |
| 4,513,486 | A | 4/1985 | Raczek | |
| 4,567,634 | A | 2/1986 | Landry | |
| 4,654,944 | A | 4/1987 | Graf | |
| 4,780,941 | A | 11/1988 | Tucker | |
| 4,807,343 | A * | 2/1989 | Wadsworth | 29/221.5 |
| 5,044,651 | A | 9/1991 | Weikel | |
| 5,052,091 | A | 10/1991 | Bryan et al. | |
| 5,349,732 | A | 9/1994 | Spence | |
| 5,365,647 | A | 11/1994 | Senkow | |
| 5,371,932 | A | 12/1994 | Bryan et al. | |
| 5,375,308 | A | 12/1994 | Harris | |
| 5,499,434 | A | 3/1996 | Zdral | |
| D377,494 | S | 1/1997 | Ewers | |
| 5,689,870 | A | 11/1997 | Robey | |
| 5,713,117 | A | 2/1998 | Bliss | |
| 5,799,563 | A | 9/1998 | Harris | |
| 6,241,270 | B1 | 6/2001 | Andre | |
| 6,321,432 | B1 * | 11/2001 | Przybyla | 29/213.1 |
| 6,374,473 | B1 | 4/2002 | Edwards | |
| 6,874,217 | B2 | 4/2005 | Ploeger et al. | |
| D509,716 | S | 9/2005 | Higdon | |

(Continued)

*Primary Examiner* — Jimmy T Nguyen
(74) *Attorney, Agent, or Firm* — Rafael V. Baca; Baca Law Firm PLLC

(57) ABSTRACT

A pistol grip spring compressor system including a spring lock unit, an actuator assembly, and an anvil module such that the spring lock unit secures a valve spring coil of a valve spring unit from an internal combustion engine in a fixed position relative to a frame element to permit an anvil, provided by the anvil module and positioned against a valve spring retainer of the valve spring unit, to maintain compression on the valve spring while the valve spring unit is separated from an automobile internal engine combustion block.

20 Claims, 9 Drawing Sheets

(56) References Cited

U.S. PATENT DOCUMENTS

| | | | | |
|---|---|---|---|---|
| 6,938,315 | B2 | 9/2005 | Alanis | |
| D511,076 | S | 11/2005 | Higdon | |
| D511,661 | S | 11/2005 | Higdon | |
| 7,765,664 | B2 | 8/2010 | Duarte | |
| 2009/0089991 | A1 * | 4/2009 | Saprykin et al. | 29/218 |

* cited by examiner

PISTOL GRIP SPRING COMPRESSOR SYSTEM AND METHOD FOR MAINTAINING COMPRESSION ON A VALVE SPRING

CROSS REFERENCE TO RELATED APPLICATIONS

This application is a Non-Provisional Application which claims benefit under 35 U.S.C. §119(e) from a prior Provisional Patent Application Ser. No. 61/376,221 filed in on Aug. 23, 2010 entitled "Manually Actuated Pistol Grip Spring Compressor Tool Apparatus and Method", by inventors Rodolfo and Alexander Lopez, the entire contents of the above referenced Application is hereby incorporated by reference as if fully set forth herein.

BACKGROUND OF THE INVENTION

1. Technical Field

The present disclosure relates generally to tools for internal combustion engines and in particular to a pistol grip spring compressor system and methods for maintaining compression on a valve spring while a valve spring unit is separated from an automotive internal combustion engine block.

2. Background

Piston driven internal combustion engines are undisputedly the primary means for transportation today. Often, each internal combustion engine has more than one piston assembly whereby each piston assembly features a valve spring unit. For dampening forces exerted by a corresponding valve stem within a piston cylinder, each valve spring unit includes a valve spring having a plurality of coils. The valve spring includes a base coil at one end. The valve spring unit further includes a valve spring retainer positioned at one end of the valve spring and keepers positioned within the valve spring and adjacent to the valve spring retainer. Moreover, a valve stem aperture, concentrically defined by the retainer, is provided, with respect to the centerline of the valve spring, to accommodate the keepers as well as the movement of the valve stem along the valve spring centerline as held by the keepers.

Overtime, during the life of an internal combustion engine, constant factors such as extreme heat and pressure as well as continuous movement at high speeds detrimentally affect a cylinder head, and in particular a valve spring unit. As a result, various problems may arise such as burnt valves, valve stems seals leaking, broken valve springs or cracked cylinder heads, that require the removal of a valve spring unit for the replacement of at least one component part.

Inasmuch, it is desirable to maintain spring compression while quickly and effortlessly repairing or replacing damaged component parts from the valve spring unit. Unfortunately, however, it is believed that no known tool exists for the removal of a valve spring unit while maintaining the requisite spring compression for operating the cylinder head during internal combustion. Nevertheless, there is a significant, continuing demand for a pistol grip spring compressor system and method for maintaining compression on the valve spring while the valve spring unit is separated from the internal engine combustion block.

DESCRIPTION OF THE DRAWINGS

The present invention is illustrated by way of example and not by limitation in the accompanying figures, in which like references indicate similar elements, and in which.

Figure 1:
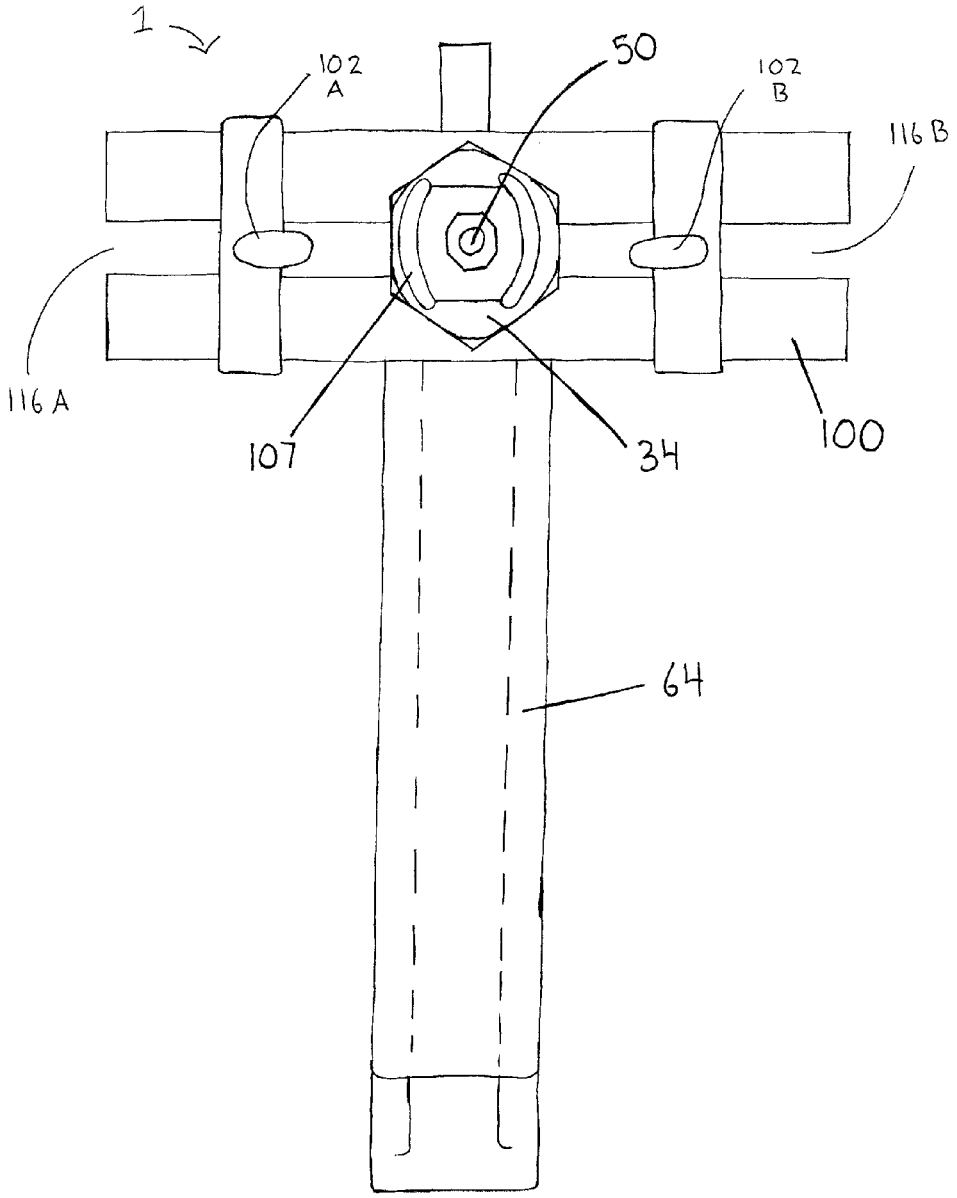
FIG. 1 is an orthographic view of a pistol grip spring compressor system in accordance with some embodiments from the front of a pistol grip spring compressor system in accordance with some embodiments.

Skilled artisans appreciate that elements in the Figures are illustrated for simplicity and clarity and have not necessarily been drawn to scale. For example, the dimensions of some of the elements in the Figures may be exaggerated relative to the other elements to help improve understanding of the embodiments of the present invention.

DETAILED DESCRIPTION

Generally speaking, pursuant to the various embodiments, the present disclosure provides a pistol grip spring compressor system and a method of maintaining compression on a valve spring of a valve spring unit. The pistol grip spring compressor system generally includes a spring lock unit, an actuator assembly, and an anvil module such that the spring lock unit secures a valve spring coil in a fixed position relative to a frame element to permit an anvil, provided by the anvil module and positioned against a valve spring retainer of the valve spring unit, to maintain compression on the valve spring while the valve spring unit is separated from an automobile internal engine combustion block. The spring lock unit includes a plurality of "J" hooks where each "J" hook has a flanged portion. In operation, the flanged portion is configured to secure the pistol grip spring compressor system to a coil of a valve spring provided by a valve spring unit from an internal combustion engine block. The actuator assembly includes a frame element, an actuator rod positioned through the frame element, a grip handle assembly to drive the actuator rod along the frame element, and a bias locking bar to lock the actuator rod in place. The grip handle assembly is coupled to and extends outwardly from the frame element and includes a fixed handle and a pivot handle pivotally coupled to the fixed handle. In operation, the pivot handle and pivot handle cooperate to drive the actuator rod along the frame element. The bias locking bar is rendered to lock the actuator rod in an advance position or rendered to reverse-release the actuator rod in an opposing direction. The anvil module is coupled to a driver end of the actuator rod and, in particular, an anvil provided by the anvil module is coupled to a driver end of the actuator rod.

Moreover, the system implements the methods as follows. A pistol grip spring compressor is secured to a coil of a valve spring provided by a valve spring unit. An anvil, at the end of an actuator rod, moves toward the coil of a valve spring that is fixed relative to a plurality of "J" hooks provided by the pistol grip spring compressor. A plurality of projection elements, provided by the anvil, are compressed to annularly contact against the valve spring retainer, about the valve stem aperture that is concentrically defined by the retainer. A bias locking bar secures the actuator rod in a fixed position relative to the frame element. Accordingly, the valve spring unit from the internal combustion engine block is separated via the pistol grip spring compressor with the actuator rod in a fixed position.

Referring now to the Figures, and particularly FIGS. 1-4, the device of the present disclosure includes a pistol grip spring compressor system 1 includes a frame member 10. The frame member 10 includes a depending fixed handle 12 with an upper frame element 14 including a forward frame section 16 and a second or rear frame section 20. The frame sections 16 and 20 are generally parallel to one another and spaced to define a window 22. A reinforcing rib 24 with a mounting projection 26 is provided on the top of the frame element 14. The rear frame section 20 includes a through bore 28 into which a cylindrical hollow fitting 30 with throughbore 31 is inserted. The forward frame section 16 also includes a throughbore 32 into which a flanged nut 34 having an internal throughbore 36 with counter bore 38 on the inside end and counter bore 40 on the outside end being provided.

Figure 3B:
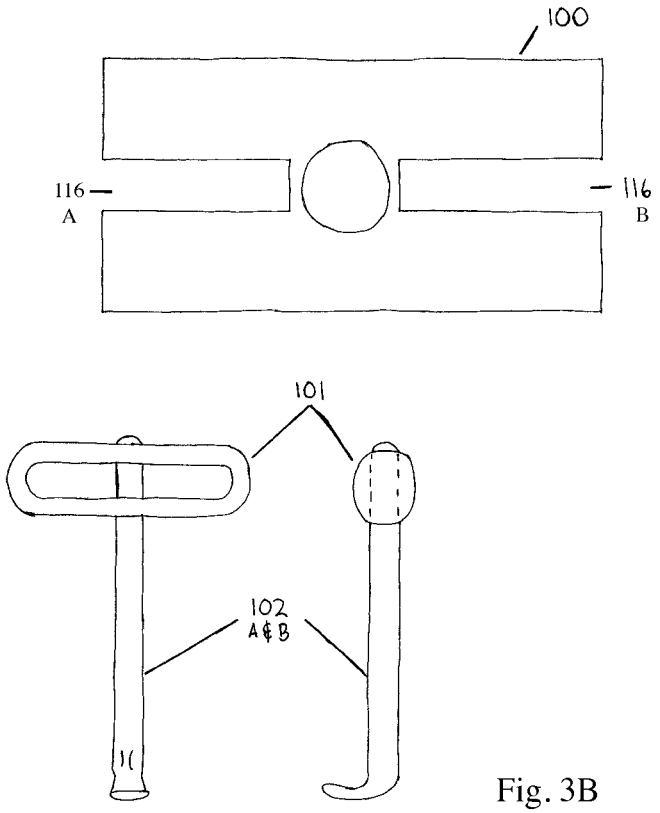
FIG. 3B is a schematic view a backing plate for anchoring a plurality of "J" hooks of a spring lock unit from one embodiment of a pistol grip spring compressor system.
Figure 4:
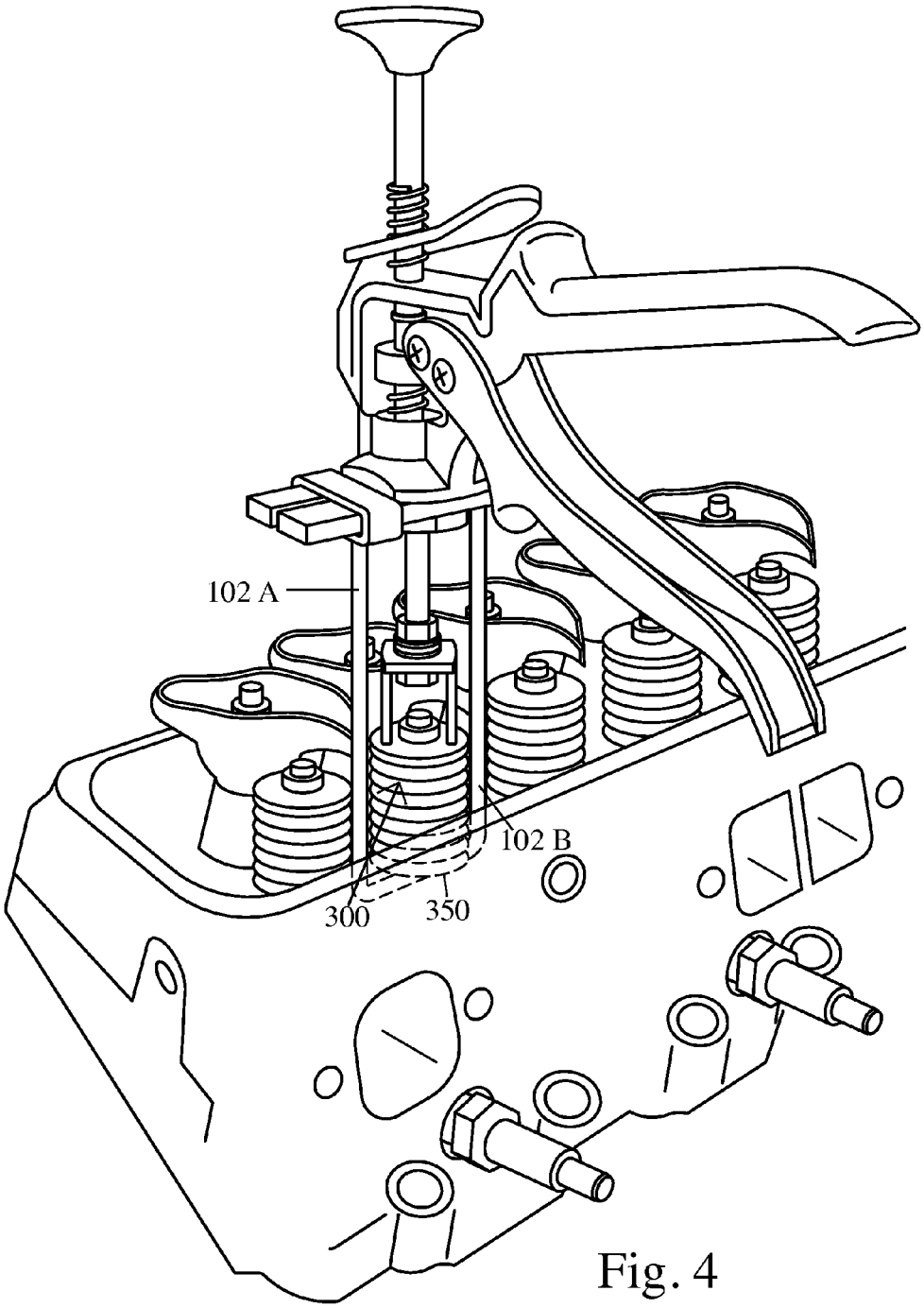
FIG. 4 is a schematic diagram illustrating a spring lock unit securing a valve spring coil in a fixed position relative to a frame element to permit the anvil positioned against the valve spring retainer, to maintain compression on the valve spring while the valve spring unit is separated from the internal combustion engine block.
Figure 5:
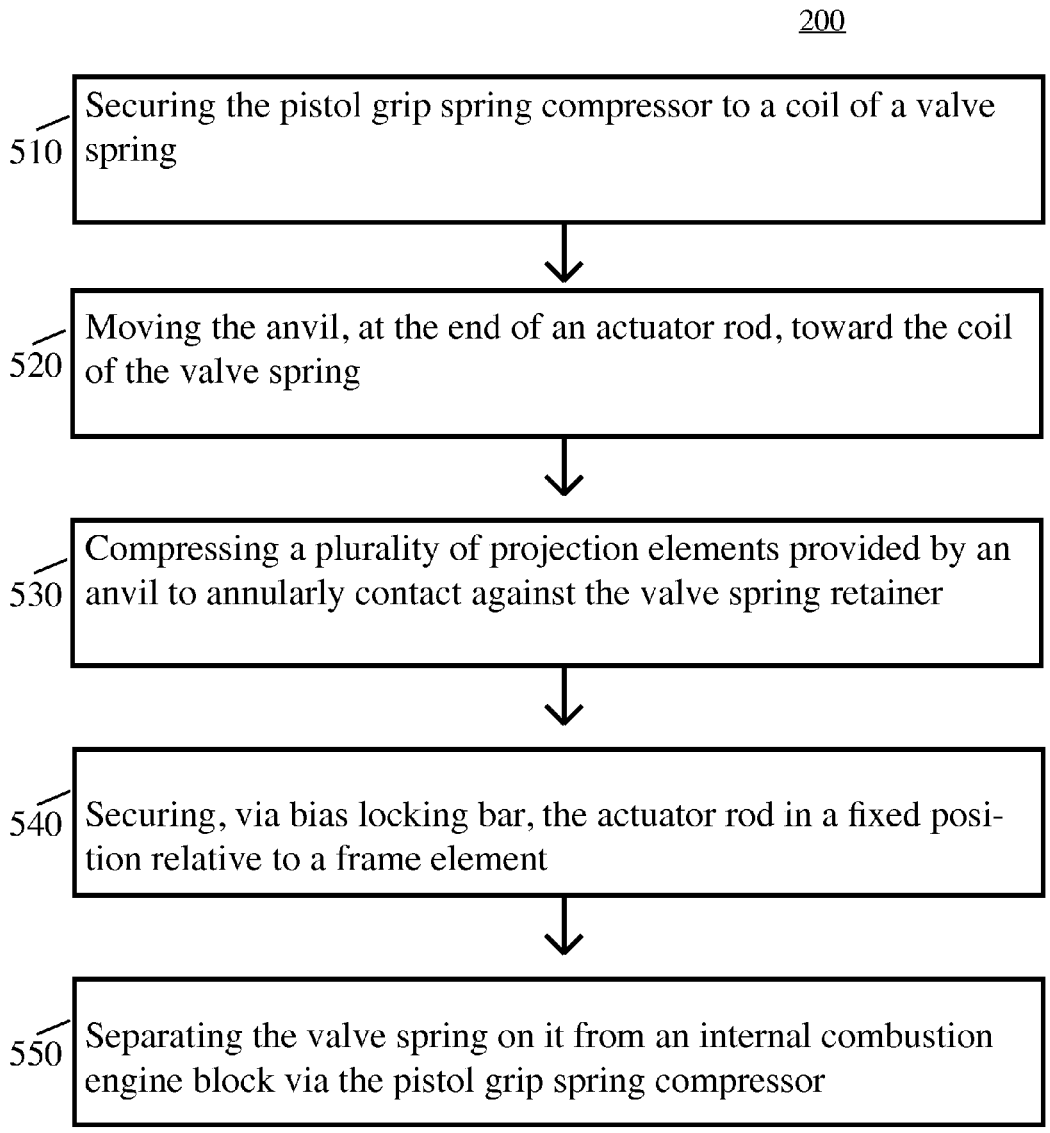
FIG. 5 is a schematic flow diagram illustrating one method of maintaining compression on a valve spring of a valve spring unit as a valve spring is separated from an internal combustion engine block.

A flanged nut 34 is threaded into the front frame section 16 and holds a backing plate 100 with slots onto the front frame section 16. In one example, the backing plate is a planar plate having a general H shape in plain view as depicted in FIG. 5. J hooks 102 A and 102B (FIG. 3B) have stabilizing guides 101A and 101B respectively attached when wedged into coil spring (FIG. 4). J hooks 102A and 102B slide onto the slots 116A and 116B of backing plate 100 and grab the base bottom of coil spring (FIG. 4).

The flanged nut 34 and, more particularly the through bore 36 as well as the through bore 31 of the hollow fitting 30, receive an actuator rod 50 having the end 110 threaded to receive a handle 111, a washer 112, a lock washer 113, a locking nut 114, and a straight section projecting through the bores 31, 36 of the fitting 30 and nut 34. An anvil 107 is attached to the outer end 56 of rod 50 with the following nut 103, bearing washer 104, bearing 105, bearing washer 106, anvil 107, washer 108, and locking nut 109, (FIGS. 3 and 4) in respective order. The following bearing 104, bearing 105 and bearing washer 106 make up the thrust bearing which allows the anvil 107 to swivel prior to actuation and to stay in position when the actuator rod 50 is turned while under compression.

The actuator rod 50 is slideable through the frame element 14 with the sliding movement control by a means of a bias feed dog 60 and a bias locking bar 62 in combination with a pivotal handle 64 mounted on the frame member 10 by means of a pivot pin 66. The pivotal handle 64 includes a lever arm extension 67 which, when pivoted on pin 66, engages with a lower side of the dog 60 and advances the dog 60 as well as the rod 50 against the biasing force of a coil spring 68 mounted on the rod 50 intermediate the dog 60 and a land 70 in the counter bore 38. Counter bore 38 functions to maintain the spring 68 appropriately guided in alignment for biasing of the dog 60.

The pistol grip spring compressor system 1 further includes the bias locking bar 62 biased by a spring member 80 about a pivot axis 82 on the reinforcing rib 24. The bias locking bar 62 includes a throughpassage into which the rod 50 fits and when the biasing spring 80 biases the bias locking bar 62, in a manor depicted in FIG. 1, where the edges of the throughpassage engage the actuator rod 50 precluding the actuator rod 50 from moving in the direction of the arrow or to the right as depicted in FIG. 1. The actuator rod 50 may, however, be manually moved in the opposite direction as illustrated in FIG. 2.

Figure 2:
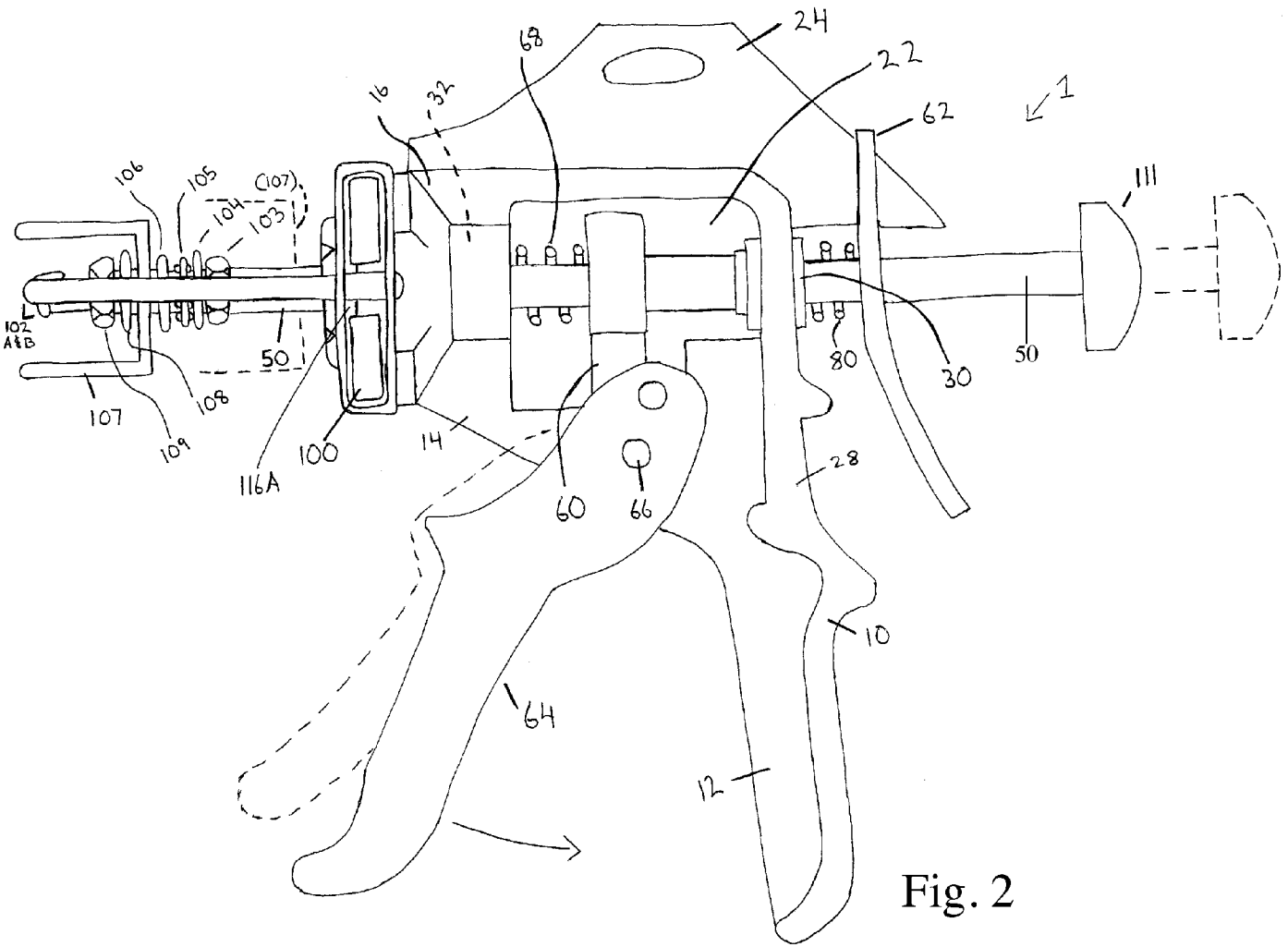
FIG. 2 is an orthographic view from one side of the spring of one embodiment of a pistol grip spring compressor system.
Figure 3:
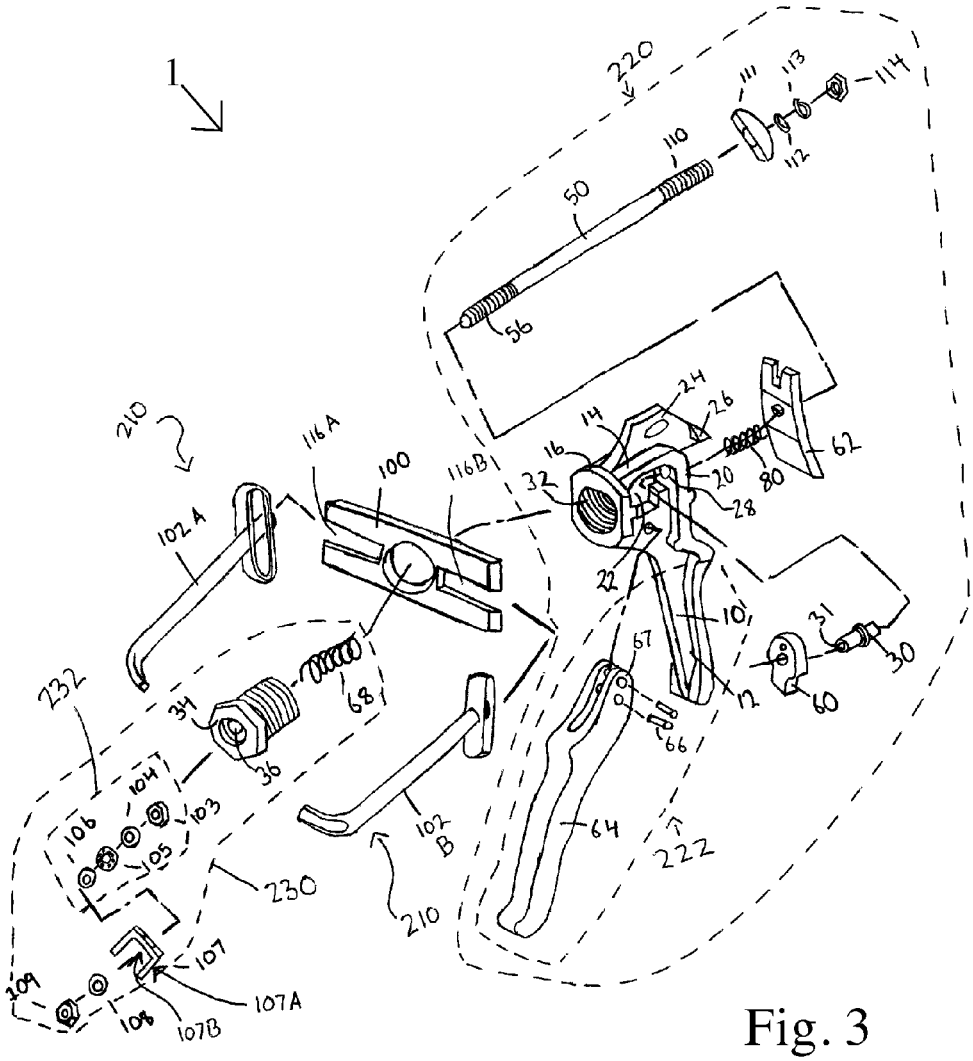
FIG. 3 is an exploded schematic isometric view of one embodiment of a pistol grip spring compressor system featuring a spring lock unit, and actuator assembly, and an anvil module.

The dog lever extension arm 67 of handle 64 provides a mechanical advantage when advancing the actuator rod 50 forward as shown in FIG. 2 as position "A". In other words, the dog 60 includes a throughpassage which is oversized relative to the outer diameter of the actuator rod 50. Driving the dog 60 forward by means of actuation of the pivotal handle 64 causes the dog 60 to become canted slightly. Thus, the dog 60 will engage the rod 50 and drive the rod 50 in the forward direction as illustrated in FIG. 2. The dog 60 will return to its un-canted, initial position upon release of the handle 64 thereby enabling the spring 68 to transport dog 60 in the opposite direction, as shown in FIG. 3 as position "B", to position the dog 60 for an additional incremental movement of the rod 50. In this manner, the anvil 107 on the end of actuator rod 50 can be driven so as to be further spaced from the backing plate 100.

The described construction provides a mechanical advantage in that the pivot handle 64 and fixed handle 12, when used in combination with the other elements of the apparatus, enable the operator to provide a significant mechanical advantage due to the long extension that is characteristic of the pivot handle 64 relative to the extension lever arm 67. The use of a locking dog 60 in combination with the bias locking bar 62 and associated biasing springs arranged in the manor depicted enables movement of the actuator rod 50 to compress the spring or springs and maintain its compression. Release of the element from a compressed position is affected by pressing on the break lever or locking plate 62 and moving at clockwise in a direction shown by the arrow in FIG. 2 against the force of the biasing spring 80. As such, the actuator rod 50 is the free to move.

Figure 3A:
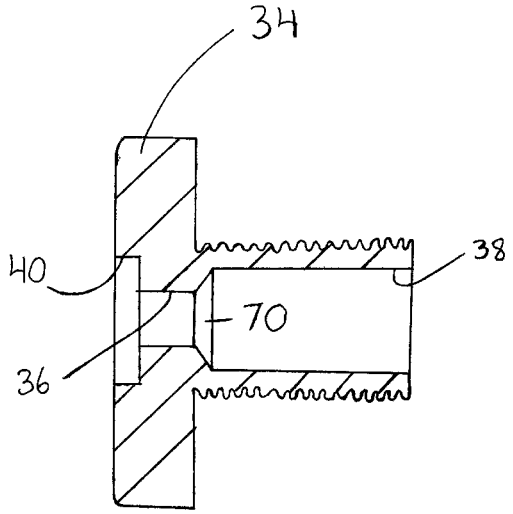
FIG. 3A is a cross sectional orthographic view from the side of one embodiment of a flanged nut for coupling an anvil to the distal end of an actuator rod of a pistol grip spring compressor system.

Importantly, as shown in FIG. 3A, the flanged nut 34 includes counterbores 38 and 40 at the opposite ends thereof. The counterbores are greater in diametrical dimensions than the bore 36 for the actuator rod 50. Accordingly, this enables the inside bore 38 to act as a guide for a dog biasing spring 68. The outside counter bore 40 enables the anvil to be positioned more closely to the backing plate 100 in as much as a mounting nut for the anvil 107 may fit within the recess define by the counter bore 40.

Variations of the constructions may be adopted. For example, the particular arrangement of the handle may be reversed with the fixed handle 12, which is a fixed handle, being made the pivoting element and the pivot handle 64 being made to be a fixed element relative to the pivoting element. The particular arrangement of the bias locking bar 62 may also be altered. Thus, while there has been set forth a preferred embodiment of the invention, it is to be understood that the invention is limited only by the following claims and equivalence thereof.

Description of Exemplary Embodiment

Controlled Release of Valve Spring

Figure 6:
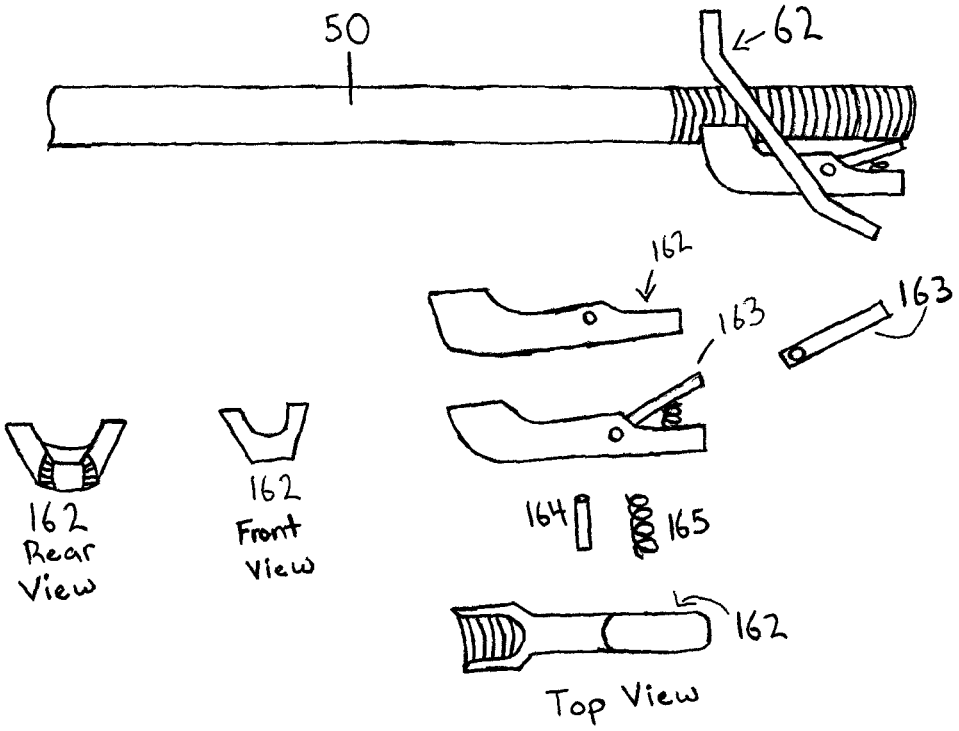
FIG. 6 an expanded view of a bias locking bar to support a controlled spring release to optionally facilitate a controlled spring release.

In one embodiment, the actuator rod 50, from the threaded end 110 to at least the center length of the actuator rod, is threaded 50 such that the locking pawl 62 is configured to receive a threaded hinged spring loaded lock 162 (FIG. 6) that will hold the threaded actuator rod 50 in one direction and will allow for smooth release when turning actuator rod 50 along the threaded portion in an opposite direction such that the anvil module 230 moves toward the actuator assembly 220. This will allow for quick compression of a valve spring 305 and the smooth release of the valve spring 305. When compressing a valve spring 305, the threaded hinge lock 162 attached to the bias locking bar 62 will allow the threaded rod 50 to slide in one direction due to pivot of hinge lock 162 and hold caused by spring tension that is place on the actuator rod 50. The hinge lock 162 has a spring 164 that will keep threads engaged and can be disengage by pressing unthreaded side of the hinge lock 162 against the threaded actuator rod 50.

Description of One Exemplary Embodiment

A Pistol Grip Spring Compressor System

Figure 3C:
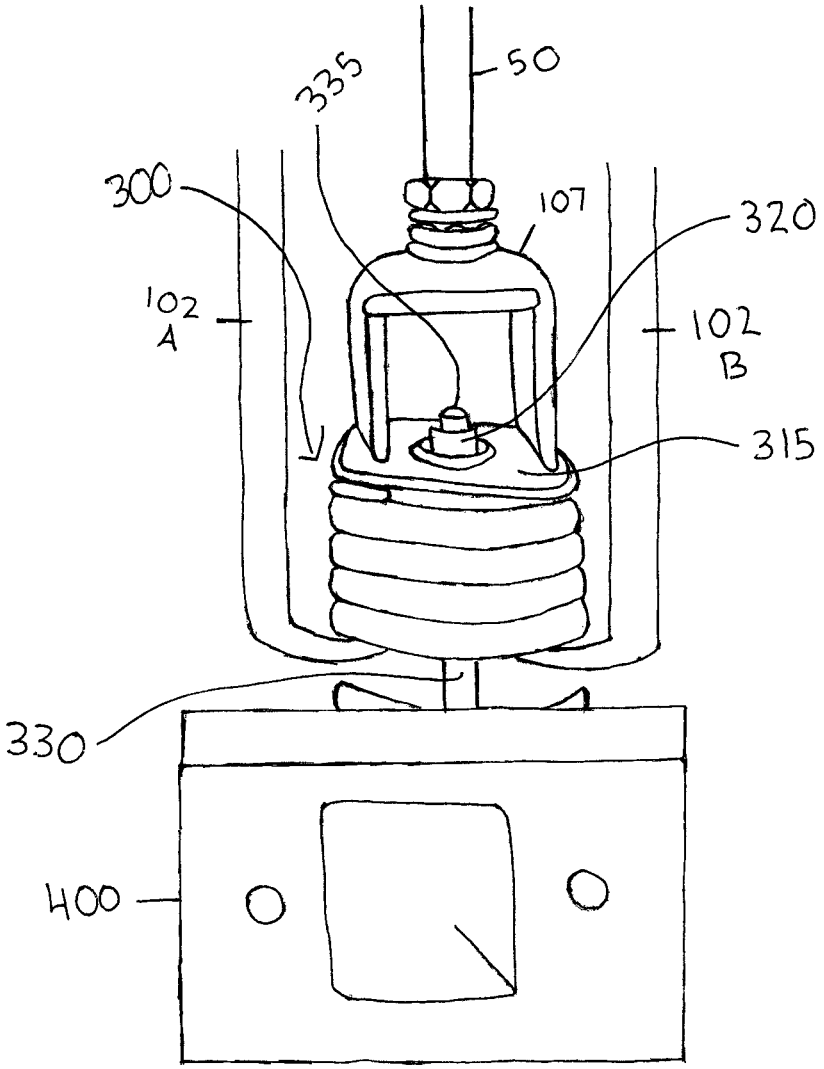
FIG. 3C is a schematic diagram illustrating at least one flanged portion from a "J" hook configured to secure the pistol grip spring compressor system to a coil of a valve spring provided by a valve spring.

One exemplary embodiment of a spring compressor system one includes the following a spring lock unit 210, an actuator assembly 220, and an anvil module 232. In particular, the spring lock unit 210 includes a plurality of "J" hooks 102A 102B. Each "J" hook features a flanged portion as illustratively shown in FIGS. 3 and 4. As shown in FIG. 3C, the flanged portion is configured to secure the pistol grip spring compressor system 1 to a coil 310 of a valve spring 305 that is provided by a valve spring unit 300 from an internal combustion engine block 400. In one embodiment, as shown in FIG. 4 each "J" hook's 102A, 102B flanged portion is configured to secure to a base portion 350 of a valve spring 305 of the valve spring unit 300.

A pistol grip spring compressor system 1 also includes a backing plate 100. As shown in FIG. 2, the backing plate is fixed to the actuator assembly 220 at the forward frame section 16. Referring to FIG. 3B, the distal end of each "J" hook 102A, 102B is secured to the backing plate 100. The backing plate 100 defines at least one guide slot 116A, 116B to permit a corresponding "J" hook 102A, 102B to move therethrough. In operation, as shown in the embodiment of FIG. 2, the guide slot 116A retains each "J" hook in operation, each guide slot 116A 116B retains a corresponding "J" hook 102A, 102B in a predetermined position as the actuator rod 50 is incrementally fed through the backing plate 100. In one embodiment, each guide slot 116A, 116B retains a corresponding "J" hook 102A, 102B in a predetermined position as the actuator rod 50 is variably fed through the backing plate 100.

The spring lock unit 210 is anchored to the actuator assembly 220. The actuator assembly 220 includes a frame element 14, an actuator rod 50, a grip handle assembly 222, and a bias locking bar 62. The actuator rod 50 is positioned through the frame element 14. The grip handle assembly 222 is coupled to and extends outwardly from the frame element 14. As illustratively shown in FIG. 3, an actuator rod 50 is positioned through the frame element 14. The grip handle assembly 222 is coupled to and extends outwardly from the frame element 14. The grip handle assembly 222 includes a fixed handle 12 and a pivot handle 64. The pivot handle 64 is pivotally coupled to the fixed handle 12. As such, in operation, the pivot handle 64 and the fixed handle 12 cooperate to drive the actuator rod 50 along the frame element 14. A bias locking bar 62 is coupled to the actuator rod 50 and selectively locks the actuator rod 50 in a fixed position. Specifically, the bias locking bar 50 is rendered to lock the actuator rod 50 in an advanced position. The advanced position in this disclosure and appended claims refers to a position of the actuator rod whereby the anvil 107 moves away from the forward frame section 16 by the actuator rod 50. Alternatively, in an opposing position to that of the advance position, the bias locking bar 62 unlocks the actuator rod 50 to become rendered in a reverse release position such that the anvil 107 moves toward the forward frame section 16 to thus define the reverse-release position in this disclosure and appended claims.

An anvil module 230 is coupled to a driver end 56 of the actuator rod 50. The anvil module 230 is configured to compress against a valve spring retainer 315 while the valve spring unit 300 is separated from the internal combustion engine block, such as an automotive internal combustion engine block. The anvil module 230 includes an anvil 107 coupled to the driver end 56. With the actuator rod 50, the anvil 107 is configured to compress against a valve spring retainer 315 of the valve spring unit 300.

Optionally, the anvil 107 is releasable from the actuator rod 50. As such, in one exemplary embodiment, one anvil having one particular configuration is interchanged with an anvil 107 having a different configuration.

The anvil 107 includes a plurality of valve projection elements 107A. In operation, the plurality of valve projection elements 107A are configured to annularly contact against the valve spring retainer 315, about the valve stem aperture 316 centrically defined by the retainer 320. The plurality of valve projection elements 107A collectively forms a holding container that defines a plurality of collection gaps 107B.

Generally, in operation, the spring lock unit 210 secures the valve spring coil 310 in a fixed position relative to the frame element 14 to permit the anvil 107, positioned against the valve spring retainer 315, to maintain compression on the valve spring 305 while the valve spring unit 300 is separated from the internal combustion engine block 400.

Illustratively, in operation, the fixed handle 12 is positioned within the palm of a hand. The fingers of the hand repetitively squeeze the pivot handle 64 toward the fixed handle 12 to drive the actuator rod 50 along the frame element 14" such that the anvil 107, at the end of the actuator rod 50, is driven toward coil 310 of the valve spring 305 that is fixed relative to the frame element 14 by the plurality of "J" hooks 102A, 102B.

The anvil module 230 in at least one embodiment includes a rotational assembly 232. The rotational assembly 232 is coupled to and positioned between the anvil 107 and the driver end 56 of the actuator rod 50. Illustratively, while in operation, the plurality of projection elements 107A rotate relative to the plurality of "J" hooks 102A, 102B to facilitate retrieval of the keepers 320 from between the plurality of collection gaps 107B.

Optionally, in one embodiment, the anvil 107 is composed of a magnetic material. As such, the anvil 107, in operation, magnetically attracts the keepers 320 from a disassembled valve spring unit 300. In one embodiment, the keepers 320 are retrieved from between the plurality of collection gaps 107B.

Description of One Exemplary Embodiment

Figure 4A:
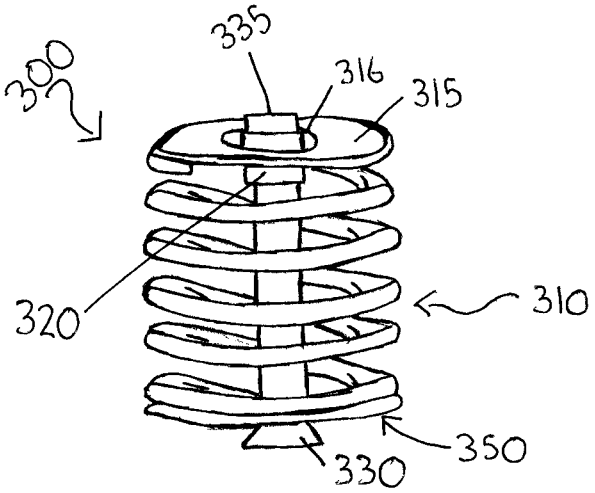

A Pistol Grip Spring Compressor for a Valve Spring Unit at an Engine Block Assembly One embodiment of a pistol grip spring compressor system 1 for a valve spring unit 300 at an engine block assembly 400 is provided as follows. As illustrated in FIG. 4A, each valve spring unit 300 at the engine block assembly 400 includes a plurality of coils 310, a valve spring retainer 315 that is positioned at one end of the valve spring 305, and keepers 320 positioned within the valve spring 305 and adjacent to the valve spring retainer 315.

The pistol grip spring compressor system 1 includes a spring lock unit 210. The spring lock unit 210 includes a plurality of "J" hooks 102A, 102B. Each "J" hook 102A, 102B includes a flanged portion as illustratively shown in FIG. 3. The flanged portion is configured to secure the pistol grip spring compressor 1 to a coil 310 of the valve spring 305 provided by the valve spring unit 300 from an internal combustion engine block 400.

The pistol grip spring compressor system 1 includes an actuator assembly 220. The spring lock unit 210 is anchored to the actuator assembly 220. Illustrated in FIG. 3, the actuator assembly 220 includes a frame element 14, an actuator rod 50 positioned through the frame element 14, a bias locking bar 62, and a grip handle assembly 222. The grip handle assembly 222 is coupled to and extends outwardly from the frame element 14. The grip handle assembly 222 includes a fixed handle 12 and a pivot handle 64 pivotally coupled to the fixed handle 12. The pivot handle 64 and the fixed handle 12 cooperate to drive the actuator rod along the actuator assembly 220, such as along the frame element 14. The bias locking bar 62 is rendered to lock the actuator rod while in an advanced position or rendered to reverse-release the actuator rod 50 in an opposing direction.

The pistol grip spring compressor system 1 further includes an anvil module 230 that is coupled to the driver end 56 of the actuator rod 50. The anvil module 230 includes an anvil 107 coupled to the driver end 62 and a rotational assembly 232 coupled to and positioned between the anvil 107 and the driver end 62. In operation, the anvil 107 is configured to compress against a valve spring retainer 315 of the spring valve unit 300, with the actuator rod 50.

The anvil 107 includes a plurality of valve projection elements 107A. The plurality of valve projection elements are configured to annularly contact against the valve spring retainer 315, about the valve stem aperture 316 that is concentrically defined by the retainer 315. The plurality of valve projection elements 107 collectively form a holding container that define a plurality of collection gaps 107B. The valve projection elements 107A rotate relative to the adjacent plurality of "J" hooks 102A, 102B to facilitate retrieval of the keepers 320 from between the collection gap 107B.

Operationally, the spring lock unit 210 secures the valve spring coil 310 in a fixed position relative to the frame element 14 to permit the anvil 107, positioned against the valve spring retainer 315, to maintain compression on the valve spring 305 while the valve spring unit 300 is separated from the internal combustion engine block 400.

Generally, one exemplary method 200 of maintaining compression of a valve spring unit 300 as a valve spring 305 is separated from an internal combustion engine block 400 is appreciated as follows. In the method 200, as shown in FIG. 5, each valve spring 300 unit includes a plurality of coils 310, a valve spring retainer 315 positioned at one end of the valve spring 305, and keepers 320 positioned within the valve spring 305 and adjacent to the valve spring retainer 315. Optionally, an anvil 107 magnetically attracts keepers 320 from the valve spring unit 300.

At step 510 of the method 200 of FIG. 5, a pistol grip spring compressor system 1 is secured to a coil of a valve spring 305 provided by the valve spring unit 300. The pistol grip spring compressor system 1 includes a spring lock unit 210, an actuator assembly 220, and an anvil module 230. The spring lock unit 210 includes a plurality of "J" hooks with each "J" hook having a flanged portion. Each flanged portion is configured to secure the pistol grip spring compressor system 1 to a coil of a valve spring 305 provided by a valve spring unit 300 from an internal combustion engine block 400. The spring lock unit 210 is anchored to an actuator assembly 220. The actuator assembly 220 includes a frame element 14, an actuator rod 50 positioned through the frame element 14, a grip handle assembly 222, and a bias locking bar 62. The grip handle assembly 222 includes a fixed handle 12 and a pivot handle 14 pivotally coupled to the fixed handle 12. The pivot handle 64 and fixed handle 12 cooperate to drive the actuator rod 50 along the frame element 14. The grip handle assembly 222 further includes a bias locking bar 62 coupled to the actuator rod 50. The bias locking bar 62 is rendered to lock the actuator rod 50 in an advanced position or render to reverse-release the actuator rod 50 in an opposing direction. The anvil module 230 includes an anvil 107 coupled to the driver end 56 of the actuator rod 50.

At 520, the anvil 107, at the end of the actuator rod 50, moves toward the coil of the valve spring 305 that is fixed relative to the plurality of "J" hooks 102A and 102B. Illustratively, in one embodiment as the fixed handle 12 is in position within the palm of a hand, the step of moving the anvil 12 includes the step of squeezing, repetitively, the pivot handle 64 toward the fixed handle 12 with the fingers of the hand to drive the actuator rod 50 along the frame element 14. In at least one exemplary embodiment, the anvil 107 rotates relative to the plurality of "J" hooks 102A and 102B.

At 530, a plurality of projection elements 107*a* provided by an anvil 107 compress to annularly contact against the valve spring retainer 315, about the valve stem aperture 316 that is concentrically defined by the valve spring retainer 315. The bias locking bar 62 at 540 secures the actuator rod 50 in a fixed position relative to the frame element 14. At 550, the valve spring unit 330 is separated from the internal combustion engine block 400 with the pistol grip spring compressor system 1 having the actuator rod 50 in a fixed position. In at least one embodiment, the actuator rod 50 is unsecured from the fixed position via the bias locking bar 62, relative to the frame element 14.

In one embodiment, unsecuring the bias locking bar 62 spring releases the actuator rod 50 in a direction away from the coil of the valve spring 305. Accordingly, in at least one embodiment, the anvil 107 at the end of the actuator rod 50 moves away from the coil of the valve spring 305 that is fixed relative to the plurality of "J" hooks 102A and 102B.

Although the present invention has been described in detail, it should be understood that various changes, substitutions, and alternations could be made hereto without departing from the spirit and scope of the invention as defined by the appended claims.

We claim:

1. A pistol grip spring compressor system for a valve spring unit at an engine block assembly, each valve spring unit includes a plurality of coils, a valve spring retainer positioned at one end of the valve spring, and keepers positioned within the valve spring and adjacent to the valve spring retainer, the pistol grip spring compressor system comprising:

a spring lock unit, the spring lock unit includes a plurality of jhooks, each jhook having a flanged portion, the flange portion is configured to secure the pistol grip spring compressor system to a coil of the valve spring provided by the valve spring unit from an internal combustion engine block;

an actuator assembly, the spring lock unit anchored to the actuator assembly, the actuator assembly includes a frame element, an actuator rod positioned through the frame element, a grip handle assembly, the grip handle assembly coupled to and extending outwardly from the frame element, the grip handle assembly including a fixed handle and a pivot handle pivotally coupled to the fixed handle, the pivot handle and fixed handle cooperate to drive the actuator rod along the frame element, the grip handle assembly further including a bias locking bar coupled to the actuator rod, the bias locking bar is rendered to lock the actuator rod in an advance position or rendered to reverse-release the actuator rod in an opposing direction; and an anvil module, the anvil module coupled to a driver end of the actuator rod, the anvil module includes an anvil coupled to the driver end and a rotational assembly coupled to and positioned between the anvil and the driver end, the anvil is configured to compress against a valve spring retainer of the valve spring unit, via the actuator rod, the anvil includes a plurality of valve projection elements, the plurality of projection elements are configured to annularly contact against the valve spring retainer, about the valve stem aperture that is concentrically defined by the retainer, the plurality of projection elements collectively form a holding container that define a plurality of collection gaps, the projection elements rotate relative to the adjacent plurality of jhooks to facilitate retrieval of the keepers from between the collection gap, whereby, the spring lock unit secures the valve spring coil in a fixed position relative to the frame element to permit the anvil, positioned against the valve spring retainer, to maintain compression on the valve spring while the valve spring unit is separated from the internal combustion engine block.

2. The pistol grip spring compressor system according to claim 1 further comprising a backing plate, the backing plate fixed to the actuator assembly, the distal end of each jhook is secured to the backing plate and wherein the backing plate defines a guide slot to permit a corresponding jhook to move therethrough, the guide slot retains each jhook in a predetermined position of as the actuator rod is fed through the backing plate.

3. The pistol grip spring compressor system according to claim 1 wherein the anvil is releasable from the actuator rod.

4. A pistol grip spring compressor system comprising:

a spring lock unit, the spring lock unit includes a plurality of jhooks, each jhook having a flanged portion, the flange portion is configured to secure the pistol grip spring compressor system to a coil of a valve spring provided by a valve spring unit from an internal combustion engine block;

an actuator assembly, the spring lock unit anchored to the actuator assembly, the actuator assembly includes a frame element, an actuator rod positioned through the frame element, a grip handle assembly, the grip handle assembly coupled to and extending outwardly from the frame element, the grip handle assembly including a fixed handle and a pivot handle pivotally coupled to the fixed handle, the pivot handle and fixed handle cooperate to drive the actuator rod along the frame element, the grip handle assembly further including a bias locking bar coupled to the actuator rod, the bias locking bar is rendered to lock the actuator rod in an advance position or rendered to reverse-release the actuator rod in an opposing direction; and an anvil module, the anvil module coupled to a driver end of the actuator rod, the anvil module includes an anvil coupled to the driver end, the anvil is configured to compress against a valve spring retainer of the valve spring unit, via the actuator rod, whereby, the spring lock unit secures the valve spring coil in a fixed position relative to the frame element to permit the anvil, positioned against the valve spring retainer, to maintain compression on the valve spring while the valve spring unit is separated from the internal combustion engine block.

5. The pistol grip spring compressor system according to claim 4 wherein in the jhook flange portion is configured to secure to a base portion of a valve spring of the valve spring unit.

6. The pistol grip spring compressor system according to claim 4 further comprising a backing plate, the backing plate fixed to the actuator assembly, the distal end of each jhook is secured to the backing plate.

7. The pistol grip spring compressor system according to claim 6 wherein the backing plate defines a guide slot to permit a corresponding jhook to move therethrough, the guide slot retains each jhook in a predetermined position as the actuator rod is fed through the backing plate.

8. The pistol grip spring compressor system according to claim 4 wherein in the anvil is releasable from the actuator rod.

9. The pistol grip spring compressor system according to claim 4 wherein the anvil includes a plurality of valve projection elements, the plurality of projection elements collectively form a holding container that define a plurality of collection gaps.

10. The pistol grip spring compressor system according to claim 9 wherein the plurality of projection elements are configured to annularly contact the valve spring retainer, about the valve stem aperture concentrically defined by the retainer.

11. The pistol grip spring compressor system according to claim 9 wherein the anvil module further includes a rotational assembly, the rotational assembly coupled to and positioned between the anvil and the driver end of the actuator rod.

12. The pistol grip spring compressor system according to claim 11 wherein the projection elements rotate relative to the adjacent plurality of jhooks.

13. The pistol grip spring compressor system according to claim 4 wherein the anvil is composed of a magnetic material, and wherein the anvil magnetically attracts the keepers from a valve spring unit.

14. The pistol grip spring compressor system according to claim 4 wherein the fixed handle is positioned within the palm of a hand, the fingers of the hand repetitively squeeze the pivot handle toward the fixed handle to drive the actuator rod along the frame element such that the anvil, at the end of the actuator rod, is driven toward the coil of the valve spring that is fixed relative to the frame element by the plurality of jhooks.

15. A method of maintaining compression on a valve spring of a valve spring unit as the valve spring is separated from an internal combustion engine block, each valve spring unit includes a plurality of coils, a valve spring retainer positioned at one end of the valve spring, and keepers positioned within the valve spring and adjacent to the valve spring retainer, the method comprising the steps of:

securing a pistol grip spring compressor system to a coil of a valve spring provided by a valve spring unit, the pistol grip spring compressor including a spring lock unit, the spring lock unit includes a plurality of jhooks, each jhook having a flanged portion, the flange portion is configured to secure the pistol grip spring compressor system to a coil of a valve spring provided by a valve spring unit from an internal combustion engine block;

an actuator assembly, the spring lock unit anchored to the actuator assembly, the actuator assembly includes a frame element, an actuator rod positioned through the frame element, a grip handle assembly, the grip handle assembly coupled to and extending outwardly from the frame element, the grip handle assembly including a fixed handle and a pivot handle pivotally coupled to the fixed handle, the pivot handle and fixed handle cooperate to drive the actuator rod along the frame element, the grip handle assembly further including a bias locking bar coupled to the actuator rod, the bias locking bar is rendered to lock the actuator rod in an advance position or rendered to reverse-release the actuator rod in an opposing direction; and an anvil module, the anvil module includes an anvil coupled to the driver end of the actuator rod;

moving the anvil, at the end of the actuator rod, toward the coil of the valve spring that is fixed relative to the plurality of jhooks;

compressing a plurality of projection elements provided by the anvil to annularly contact against the valve spring retainer, about the valve stem aperture that is concentrically defined by the retainer;

securing, via the bias locking bar, the actuator rod in a fixed position relative to the frame element; and separating the valve spring unit from the internal combustion engine block via the pistol grip spring compressor system with the actuator rod in a fixed position.

16. The method according to claim 15 wherein the step of moving the anvil includes the step of squeezing, repetitively, the pivot handle toward the fixed handle with the fingers of the hand to drive the actuator rod along the frame element.

17. The method according to claim 15 further comprising the step of unsecuring the actuator rod from the fixed position, via the bias locking bar, relative to the frame element.

18. The method according to claim 15 further comprising the step of moving the anvil, at the end of the actuator rod, away from the coil of the valve spring that is fixed relative to the by the plurality of jhooks.

19. The method according to claim 15 further comprising the step of attracting, magnetically, keepers from the valve spring unit with the anvil.

20. The method according to claim 15 further comprising the step of rotating the anvil relative to the plurality of jhooks.

* * * * *